US007004227B2

(12) United States Patent
Xu et al.

(10) Patent No.: US 7,004,227 B2
(45) Date of Patent: Feb. 28, 2006

(54) IMPACT PAD FOR DIVIDING AND DISTRIBUTING LIQUID METAL FLOW

(75) Inventors: Dong Xu, Mississauga (CA); Lawrence Heaslip, Burlington (CA); James Dorricott, Burlington (CA)

(73) Assignee: Vesuvius Crucible Company, Wilmington, DE (US)

( * ) Notice: Subject to any disclaimer, the term of this patent is extended or adjusted under 35 U.S.C. 154(b) by 9 days.

(21) Appl. No.: 10/477,473

(22) PCT Filed: May 22, 2002

(86) PCT No.: PCT/US02/16195

§ 371 (c)(1),
(2), (4) Date: Nov. 12, 2003

(87) PCT Pub. No.: WO02/094480

PCT Pub. Date: Nov. 28, 2002

(65) Prior Publication Data

US 2004/0135298 A1 Jul. 15, 2004

Related U.S. Application Data

(60) Provisional application No. 60/292,568, filed on May 22, 2001.

(51) Int. Cl.
*B22D 41/08* (2006.01)

(52) U.S. Cl. ..... 164/437; 222/594

(58) Field of Classification Search ..... 164/418, 164/437; 266/594, 45, 275, 236, 590, 591; 222/590, 591, 594
See application file for complete search history.

(56) References Cited

U.S. PATENT DOCUMENTS

| | | | |
|---|---|---|---|
| 4,776,570 A | 10/1988 | Vo Thanh et al. | |
| 5,072,916 A | 12/1991 | Soofi | |
| 5,131,635 A | 7/1992 | Soofi | |
| 5,133,535 A | 7/1992 | Soofi | |
| 5,188,796 A | 2/1993 | Soofi | |
| 5,358,551 A | 10/1994 | Saylor | |
| RE35,685 E | 12/1997 | Schmidt et al. | |
| 5,861,121 A | 1/1999 | Heaslip et al. | |
| 5,868,955 A | 2/1999 | Taverier | |
| 6,156,260 A | 12/2000 | Heaslip et al. | |
| 6,554,167 B1 * | 4/2003 | Barrett | 222/594 |

FOREIGN PATENT DOCUMENTS

EP 0847821 A1 6/1998

* cited by examiner

*Primary Examiner*—Len Tran
(74) *Attorney, Agent, or Firm*—Robert S. Klemz, Jr.; Donald M. Satina

(57) ABSTRACT

A tundish impact pad for use in the continuous casting of molten metal is described that includes a base plate having an upper impact surface surrounded, at least in part, by a sidewall defining passageways. The impact pad is adapted to receive and deflect an incoming stream of molten metal, and permit outflow of the deflected stream through the passageways and the open top surface of the pad. Vaulted-stepped features surrounding the passageways and/or weir-like walls assist in directing the outflow. The division and distribution of the outflow facilitates the development of plug flow in the molten metal between the impact pad and the tundish outlet.

12 Claims, 9 Drawing Sheets

FIG. 7
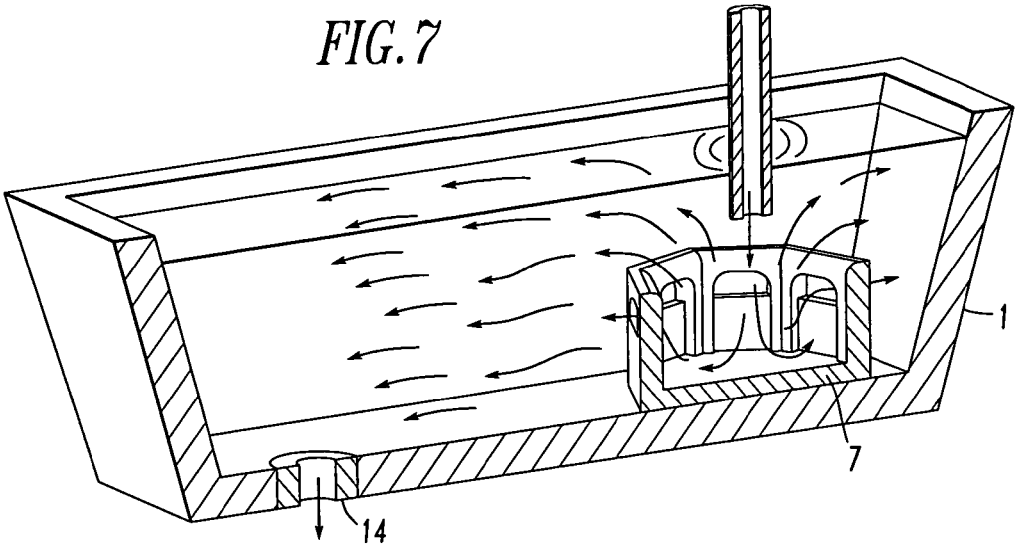
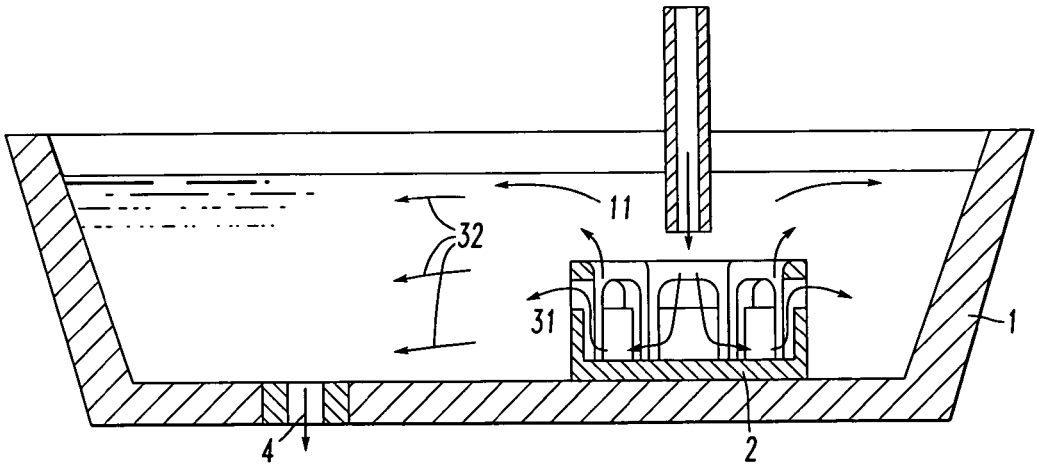
FIG. 8

IMPACT PAD FOR DIVIDING AND DISTRIBUTING LIQUID METAL FLOW

This application claims priority to U.S. provisional application No. 60/292,568, filed May 22, 2001.

FIELD OF THE INVENTION

The invention is directed to an apparatus for reducing surface turbulence in a molten metal bath and more particularly to an impact pad for controlling the fluid flow pattern of an incoming ladle stream for the purpose of reducing surface turbulence in a tundish during continuous casting.

BACKGROUND OF THE INVENTION

During casting processes, molten metal flows from a first vessel into a second vessel or mold. For example, a common practice in the continuous casting of steel is to transfer the molten metal from a ladle vessel into a tundish vessel and from the tundish vessel into a mold or molds. A stream of molten metal typically issues from a nozzle, tube or shroud attached to the bottom of the ladle, and enters the tundish as a downwardly falling stream. The metal typically leaves the tundish as one or more exiting streams that flow through outlets in the bottom of the tundish.

Water modeling is an accepted method of simulating the flow of molten metal, and has been used to examine the flow of a stream of molten steel from a ladle into a tundish. Water modeling has shown that an incoming ladle stream is deflected from the tundish floor toward the surface of the molten steel. The deflected stream can surge upwards and generate excessive turbulence at the surface of the molten steel. Structural barriers, such as tundish side and end walls, can exacerbate turbulence. Excessive turbulence can disrupt the protective flux cover on the surface and incorporate flux particles in the molten steel. The resultant exposure to air can oxidize the steel. Flux particles can create inclusions in the solidified steel. Both factors negatively impact the final product.

Tundish impact pads are used to protect a tundish lining-from erosion by the ladle stream, but they are also used to control the deflected stream, turbulence and the flow of molten metal in a tundish. An impact pad is positioned on the bottom of the tundish to receive the incoming ladle stream. The impact pad includes an upper surface that is resistant to the impact force and erosive influence of the incoming stream of molten metal. When erosion of the impact pad does occur, the impact pad is more easily replaced than the tundish lining. The upper surface of the impact pad will generally be larger than the cross-section or diameter of the incoming steam to accommodate lateral and vertical movement of the tundish relative to the ladle.

A tundish impact pad of the prior art may simply consist of a flat slab of refractory material defining an upper surface. The impact pad may be placed upon or recessed in the bottom of the tundish. The pad will preferably be positioned beneath the ladle shroud such that the incoming stream will impact upon the upper surface of the pad. This configuration often does not attempt to control the deflected ladle stream.

Prior art also includes impact pads designed improve tundish flow behavior by redirecting the deflected stream. Prior art pads include shapes intended to alter the deflection pattern of the incoming stream and the overall flow behavior in a tundish bath so as to reduce splashing and turbulence in a tundish. U.S. Pat. No. 5,072,916 to Soofi teaches an impact pad with a wavy upper surface and wavy sidewalls that redirects and decelerates the reflected flow while reducing splashing, agitation, and turbulence of the flow. U.S. Pat. No. 5,358,551 to Saylor describes an impact pad with an endless sidewall completely around the periphery of the upper surface of the pad thereby defining an impact pad with an interior space. The endless sidewall includes an undercut that reverses the flow upwardly and inwardly.

US Re. 35,685 to Schmidt et al teaches an impact pad comprising an outer sidewall with an undercut surface that redirects and reverses the flow back on the incoming stream. Unlike Saylor, this sidewall is not described as endless, that is, the sidewall does not wrap entirely around the periphery of the upper surface. A primary portion of the flow exits along the bottom of the tundish toward the tundish opening, and is not directed upwardly toward the metal surface.

U.S. Pat. No. 4,776,570 to Vo Thanh et al. teaches a ladle stream breaker, which consists of a closed box having a top wall and lateral walls. The top wall contains an opening into which the lower end of the ladle shroud is fitted so that the incoming stream enters the box. Lateral walls have a plurality of simple, straight holes that allow the molten metal to exit the box as a plurality of low energy sub-streams. Without the top wall, the molten metal has no incentive to exit the holes and would likely exit out the top of the stream breaker. The stream breaker is described as inhibiting slag entrainment and allowing better inclusion separation. Unlike an impact pad, the stream breaker is a closed box having a top wall. Further, the stream breaker is fixed to the ladle shroud and impedes the relative lateral movement between the ladle and the tundish. Freedom to move the ladle shroud relative to the tundish is very advantageous, and arguably essential, to casting operations. The present inventors are aware of no use of ladle stream breakers.

Prior art impact pads do not adequately control the flow of molten metal in a tundish. Flat impact pads can exhibit excessive splash resulting in surface turbulence and oxidation of the metal. Slag entrainment can occur as the result of the strong upward flow components near the tundish walls and downward drag around the incoming stream. This behavior may result in dirtier steel and generally reduced metal quality. Shaped impact pads primarily redirect the flow upward toward the top surface of the tundish. The redirection of flow toward the bath surface may disturb this surface resulting in turbulence and liquid metal contamination by slag and gas. Also the overall flow pattern, developed in the tundish bath by prior art pads with an endless sidewall, does not provide the best opportunity for non-metallic floatation or for reducing the mixing between metal chemistries during chemical transition. Impact pads of the prior art with a sidewall that is not endless primarily redirect the flow outward near the bottom of the tundish. This redirection is beneficial in reducing surface disturbance does not provide the best conditions for non-metallic floatation or for reducing the mixing between metal chemistries.

Prior art impact pads with or without sidewalls, do not redirect flow in such a way that the flow is divided and distributed in a controlled manner between both the upward and outward directions, thereby reducing surface turbulence and simultaneously permitting separation of inclusions.

SUMMARY OF THE INVENTION

The tundish impact pad of the present invention includes a base plate having an upper impact surface surrounded by a sidewall defining passageways. The sidewall may be endless and, with the base plate, will then define an interior volume having an open top surface.

The impact pad is adapted to receive and deflect an incoming stream of molten metal on the impact surface. The impact pad is adapted to permit flow of the deflected stream through the passageways. With an endless sidewall, flow can escape the interior volume only through the open top surface and the passageways.

An object of the present invention is to provide an impact pad that deflects the incoming stream parallel to the upper impact surface. The pad then divides and distributes this deflected flow into separated portions that travel outward from the pad through the plurality of passageways in the sidewall and upward through the top surface.

Another object of the present invention is to provide an impact pad that divides and distributes a deflected flow between both upward and outward directions, so as to reduce surface disturbance of the molten metal bath.

Another object of the present invention is to provide an impact pad that encourages plug flow of the molten metal in the tundish, particularly plug flow of the deflected stream from the impact pad to the tundish outlet.

A still further object of the present invention is to divide the flow between the upward and outward directions so as to reduce the sensitivity of the flow to disturbances and asymmetries caused by the incoming stream striking off-center on the impact surface.

In one embodiment, the impact pad comprises a base plate surrounded by a perforated sidewall having a plurality of passageways. Preferably, the sidewall includes features that channel the deflected steam toward the passageways. These features could include deflecting surfaces above and below the passageway.

In another embodiment, weir-like walls divide the interior volume into a plurality of chambers, thereby decelerating the deflected stream. The deflected stream passes above or around the walls towards the perforated sidewall, and exits the interior volume through the passageways or the top boundary.

BRIEF DESCRIPTION OF THE DRAWINGS

FIG. 7 is a cross-sectional view of an impact pad of the present invention showing flow patterns.

FIG. 8 is a cross-sectional view of an impact pad of the present invention showing plug flow.

DETAILED DESCRIPTION OF THE INVENTION

Figure 1:
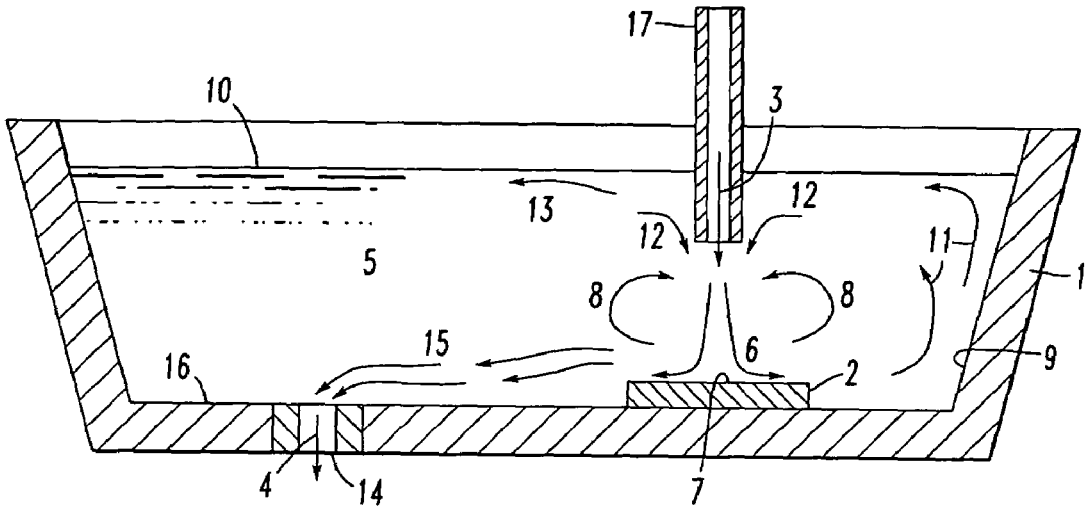
FIG. 1 PRIOR ART
FIG. 1 is a cross-sectional view of a tundish and prior art, flat slab impact pad showing flow patterns.

FIG. 1 is a sectional illustration of a flat slab impact pad 2 of the prior art disposed within a tundish 1. Arrows illustrate an incoming stream 3 entering the tundish 1, an exiting stream 6 leaving the tundish 1, and certain other flow components of the molten metal contained in a tundish volume 5. The overall flow pattern in a tundish volume 5 has a large number of components as the molten metal splashes and churns throughout the tundish volume 5. The impact surface 7 of the pad 2 deflects the incoming flow 3 outwardly to create a deflected flow 6. A portion of the deflected flow 6 reverses direction and moves upwardly and inwardly toward the incoming stream 3 to form a reverse flow 8. Another portion of the deflected flow 6 creates an upward flow 11 that travels upward beside the walls 9 of the tundish 1 toward the top surface 10 of the molten metal. The upward flow 11 can cause surface turbulence and mixing of the molten metal with flux at the top surface 10. A downward flow 12 occurs as the incoming stream 3 drags a portion of the surrounding molten metal downward. Downward flow 12 can also incorporate flux from the top surface 10 into the molten metal. A surface flow 13 may move along the top surface 10 toward the tundish outlet 14, while a short-circuit flow 15 follows a shorter path to the tundish outlet 14 as it moves near the tundish bottom 16 toward the outlet 14. Short-circuit flow 15 limits the opportunity for floatation of impurities in the molten metal. The flat slab impact pad 2 of FIG. 1 does not effectively retard undesirable flow patterns, including short-circuit flow 15, upward flow 11, and downward flow 12.

Figure 2:
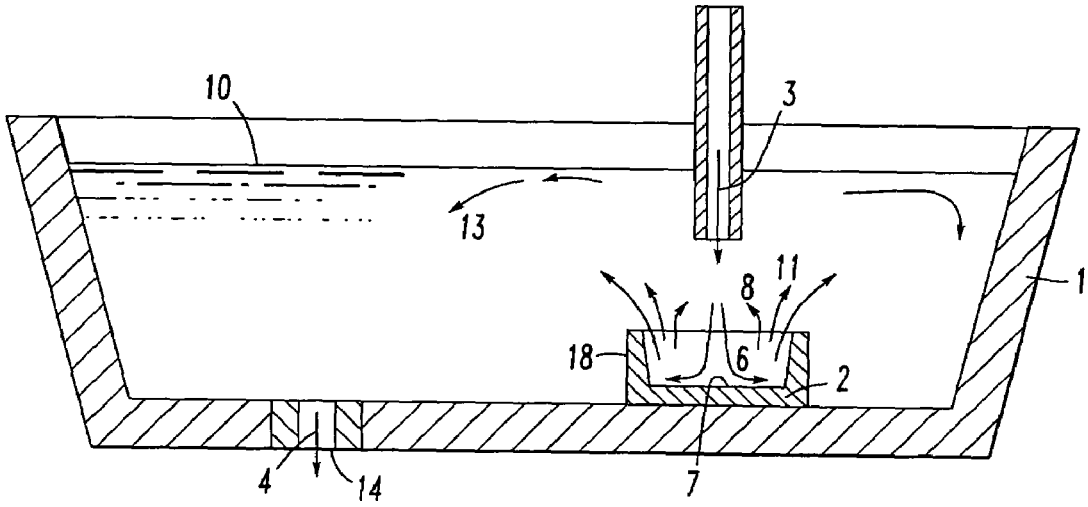
FIG. 2 PRIOR ART
FIG. 2 is a cross-sectional view of a tundish and prior art impact pad having a straight sidewall showing flow patterns.
Figure 3:
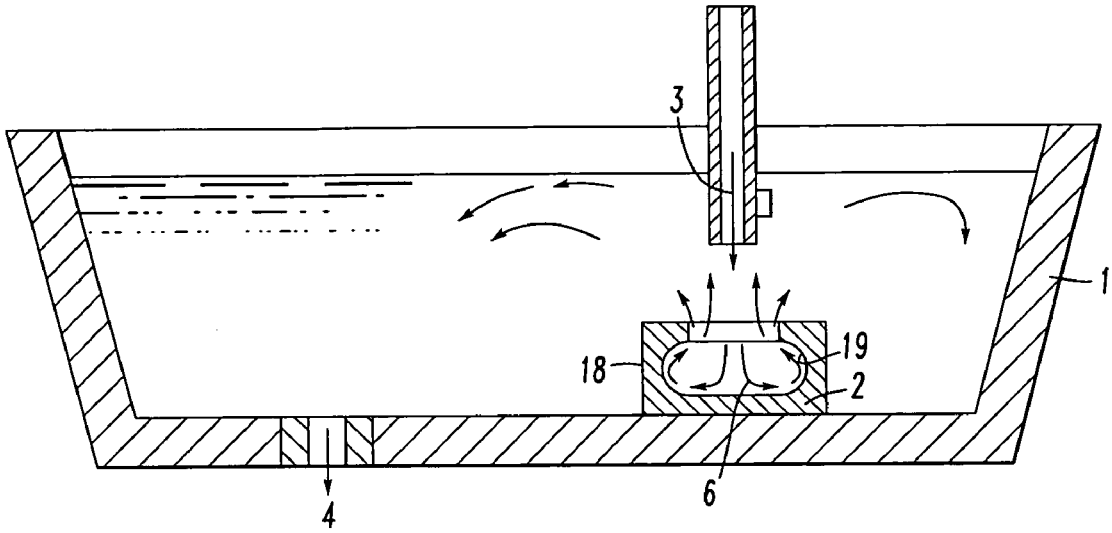
FIG. 3 PRIOR ART
FIG. 3 is a cross-sectional view of a tundish and prior art impact pad having an inwardly curving sidewall showing flow patterns.

FIG. 2 illustrates a tundish 1 having an impact pad 2 of the prior art with an endless sidewall 18. A major portion of the incoming flow 3 moves in a downward direction until the impact surface 7 of the pad 2 causes a deflected flow 6 to move outwardly from the pad 2. A reverse flow 8, which is a portion of the deflected flow 6, moves upwardly and inwardly toward the incoming stream 3. Another portion of the deflected flow 6 produces an upward flow 11 that moves in an upward and outward direction as it leaves the interior space of the pad 2. Another portion of the defected flow 6 forms an upward flow 11 that leaves the interior space of the pad 2 in a largely upward direction. As in FIG. 1, a surface flow 13 approaches the top surface 10 of the molten metal and moves along the top surface 10 toward the tundish outlet 14. Similarly, FIG. 3 shows a prior art impact pad 2. This pad has an endless outer sidewall 18 having an undercut surface 19 that faces the deflected flow 6. The deflected flow 6 is described as turning upwardly and inwardly. Flow patterns are otherwise similar to those of FIG. 2.

Figure 4:
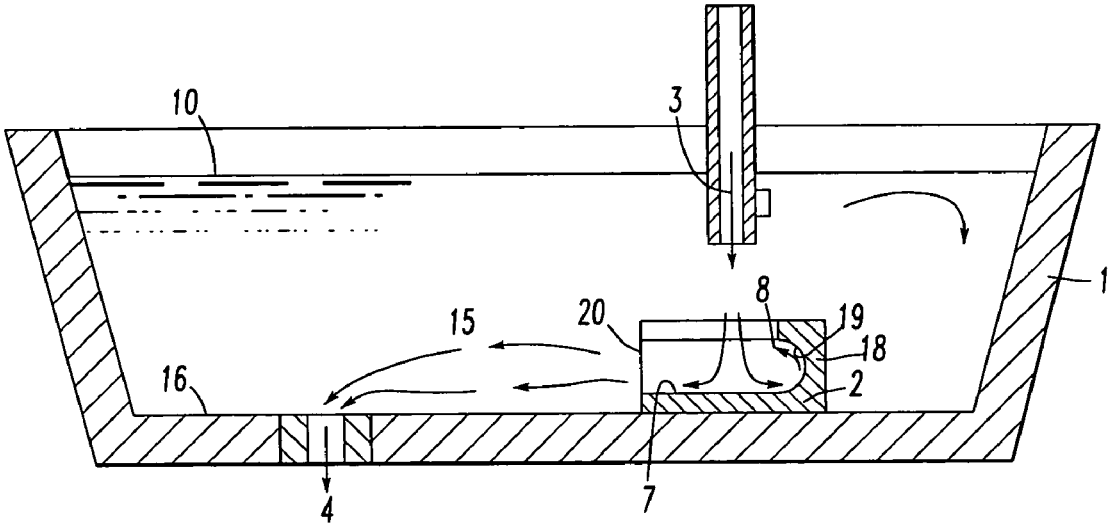
FIG. 4 PRIOR ART
FIG. 4 is a cross-sectional view of a tundish and prior art impact pad having a partial inwardly curving sidewall showing flow patterns.

FIG. 4 is a sectional illustration of tundish 1 with another impact pad 2 of the prior art. As in the earlier figures, the incoming flow 3 continues to move in a downward direction until the impact surface 7 of the impact pad 2 creates a deflected flow 6 moving outwardly. A sidewall 18 includes an undercut surface 19 that reverses the deflected flow onto the incoming flow 3. The prior art teaches that the reversed flow 8 exiting the pad 2 does not travel upward toward the top surface 10 but rather travels outwardly through the open end 20 of the pad 2 where there is no sidewall. The short-circuit flow 15 remains generally near the bottom 16 of the tundish 1 until the short-circuit flow 15 exits the tundish 2 at the outlet 14.

Prior art impact pads do not produce ideal flow of molten metal within the tundish. For example, FIGS. 2 and 3 show an endless outer sidewall. Both pads direct the flow departing the interior of the pad in a generally upward direction toward the top surface of the bath. An upward flow can disturb the top surface of the molten metal in the tundish. Disturbance of the surface and the resultant turbulence can cause deleterious interactions between the molten metal and the slag or gaseous atmosphere above the liquid metal surface. These problems are exacerbated if the incoming stream does not strike the center of the impact surface, in which case the upward flow is asymmetric and can be higher in velocity. FIGS. 1 and 4 produce a substantial quantity of short-circuit flow that reduce the likelihood contaminates will separate from the flow before exiting the tundish.

Plug flow is a type of flow that it reduces, and ideally eliminates, mixing and turbulence. Plug flow permits material to enter and exit a vessel as a "plug," where each plug has a similar residence time in the vessel. Plug flow in a tundish would correspond to a uniform flow from the ladle shroud to the tundish outlet. Plug flow limits disruption and turbulence at the top surface and the resultant potential for contamination of the metal. Plug flow also controls short-circuiting of the flow, and thereby increases the time and opportunity for the separation of non-metallic dirt from the steel by floatation. Additionally, plug flow provides desirable conditions for chemical transition in a tundish by reducing the extent of swirling eddies that cause mixing between the liquid already present in the bath and the new liquid entering the bath. Plug flow would be advantageous in casting because it could reduce turbulence and, therefore, reduce oxidation and slag entrainment. Prior art impact pads do not create plug flow in the tundish. The incoming stream mixes with material already in the tundish and a plurality of residence times result, thereby resulting in short-circuiting of residence times and stagnation regions in the tundish. Such a flow pattern is undesirable and adversely affects separation efficiency of non-metallic species from the liquid metal.

Figure 5A:
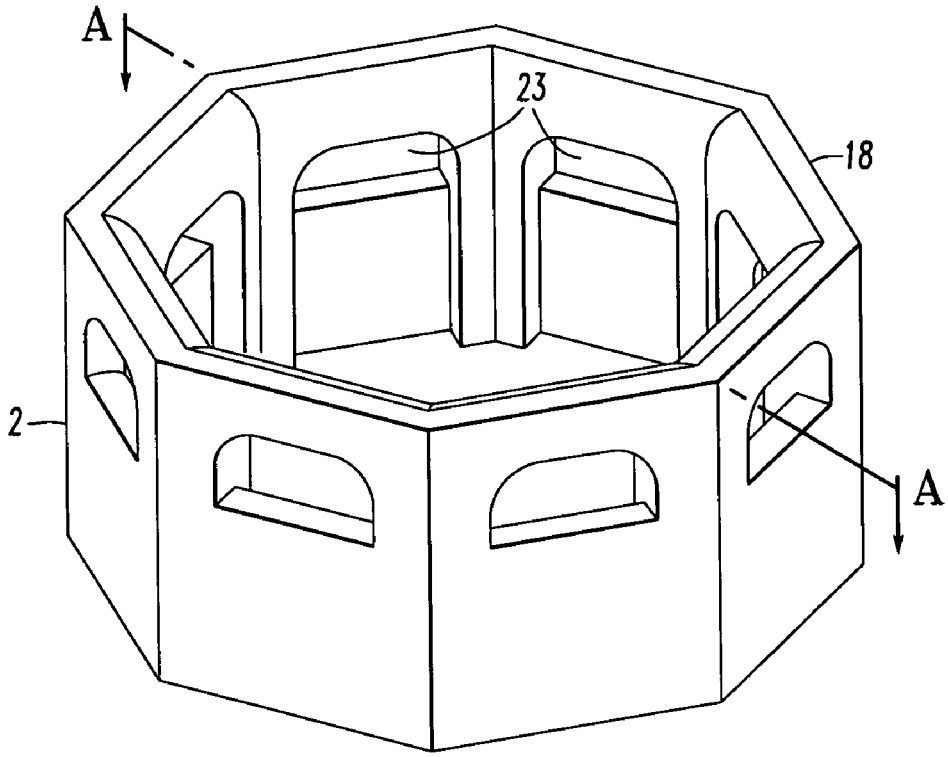
FIG. 5*a* is a perspective view of an impact pad of the present invention.
Figure 5B:
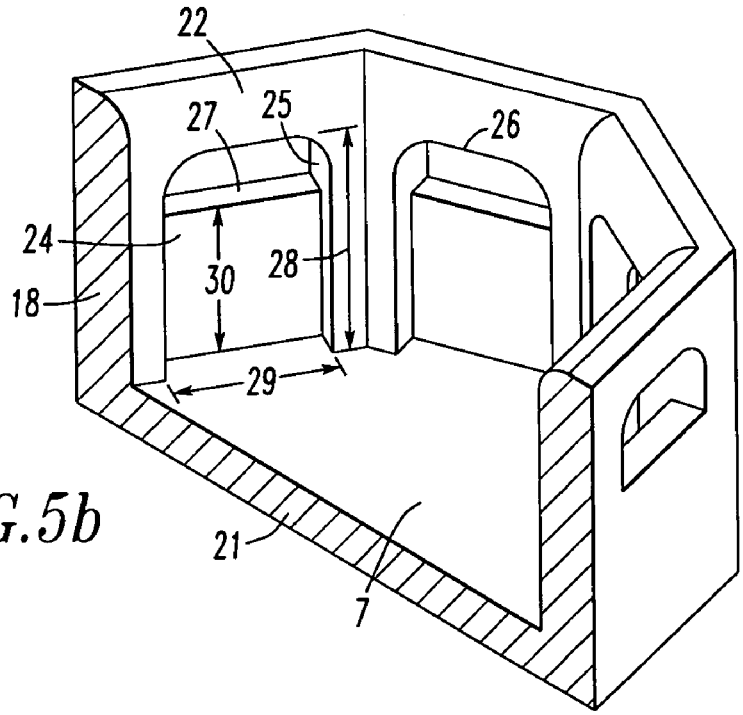
FIG. 5*b* is a sectional perspective view along A—A of an impact pad of the present invention.
Figure 5C:
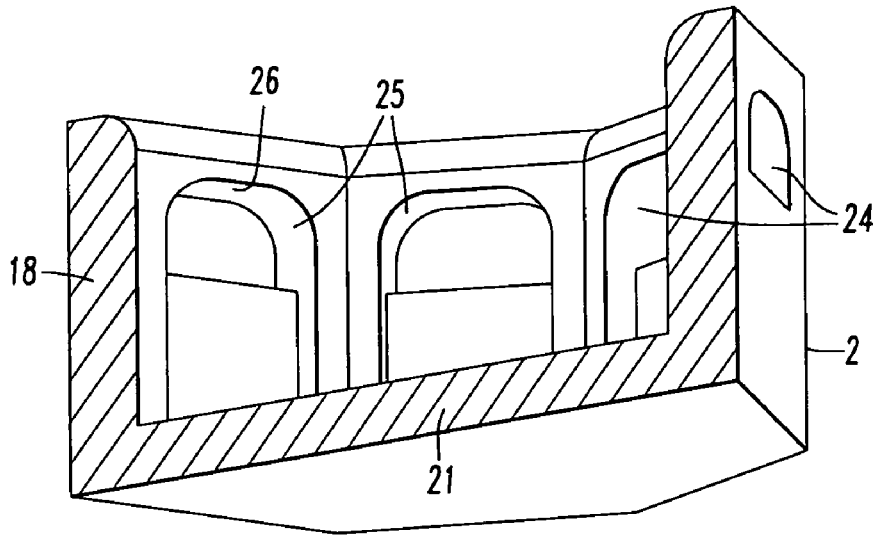
FIG. 5*c* is an alternative sectional perspective view of an impact pad of the present invention.

An impact pad of the present invention is shown in FIGS. 5*a*, 5*b* and 5*c*, where 5*a* shows a perspective view of the pad, 5*b* shows a transection along A—A, and 5*c* shows the transected pad from a lower perspective. The pad 2 comprises a base plate 21 having an upper impact surface 7. The impact surface is at least partially surrounded by a sidewall 18. The sidewall 18 includes an interior surface 22 and is generally located at the periphery of the impact surface 7. The sidewall 18 defines a plurality of passageways 23. The interior surface 22 may include a vaulted-stepped architecture 24 around the passageways 23. The vaulted-step architecture 24 includes a first bounding surface 25 forming a vault 26. The vault 26 is formed in or on the sidewall and includes a lofted roof and walls. The passageways may also include a third surface comprising at least one face that forms a step 27 in the passageways.

One embodiment of the present invention comprises a generally octagonal pad with an endless sidewall having eight facets with one vaulted-step passageway per facet for a total of eight passageways. The faces defining the passageways are generally perpendicular to the interior surface 22. A vault 26 extends upward from the impact surface 7, a vault height 28, and the vault spans a distance 29. The vaulted passageway has a step height 30. In this embodiment, each passageway has the same vault height 28, the same vault span 29, and the same step height 30, but alternative embodiments may have passageways of varying dimensions.

Figure 6:
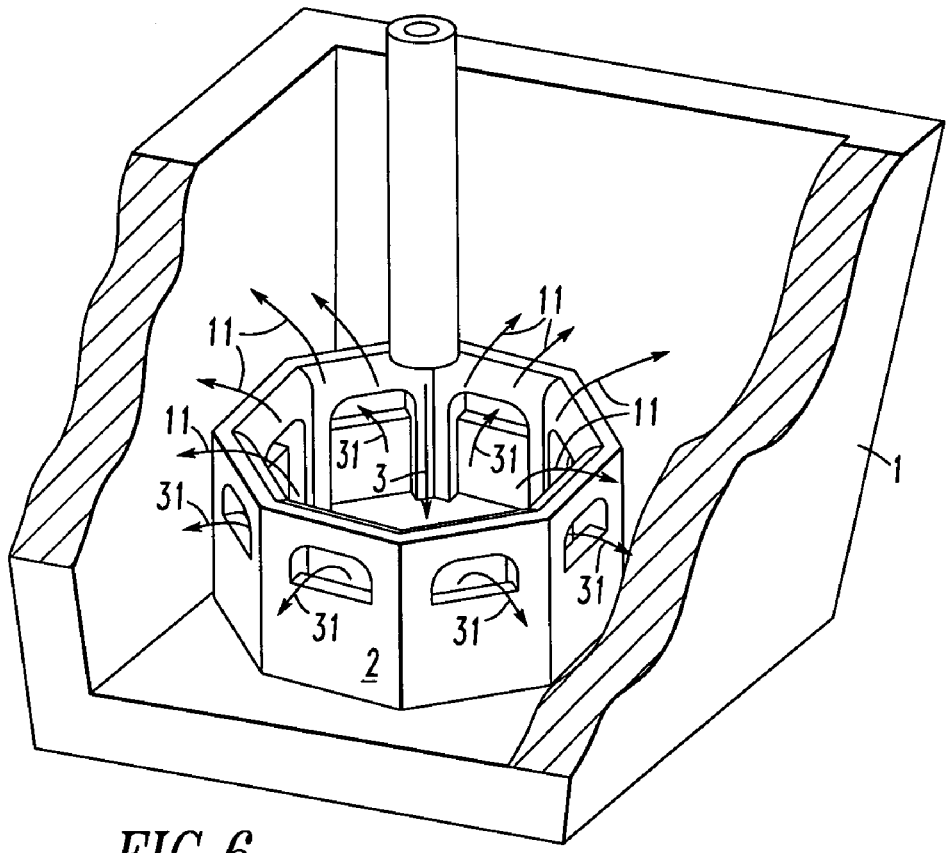
FIG. 6 is perspective view of an impact pad of the present invention within a tundish, including flow patterns.

FIGS. 6 and 7 illustrate flow behavior in a tundish 1 with an impact pad 2 of the present invention. FIG. 6 shows flow behavior immediately surrounding the pad. Downward flow 3, which is generated by the incoming stream to the tundish 1, impacts the impact surface 7 of the pad. The unique structure of the passageways through the sidewall of the pad causes the flow to be divided between generally upward flows 11 and generally outward flows 31. The outward flows 31 are distributed into a plurality of separate streams that move outwardly through each of the passageways. FIG. 7 shows flow in the bulk of the tundish 1 where the molten metal is moving toward the tundish outlet 14. Plug flow is readily developed in a tundish 1 as the molten metal moves toward the outlet 14. As shown in FIG. 8, the impact pad 2 enhances development of plug flow 32 in the tundish 1 because the impact pad 2 divides flow between both the upward direction 11 and the outward direction 31 providing a more diffuse flow, which readily develops into plug flow as the molten metal moves toward the outlet 4. The upward and outward flow division also reduces disturbances of the top surface of the bath, as the flow is not primarily directed upwardly, but is instead directed both upwardly and outwardly as well as being divided into separate streams that travel outward through the passageways.

Figure 9A:
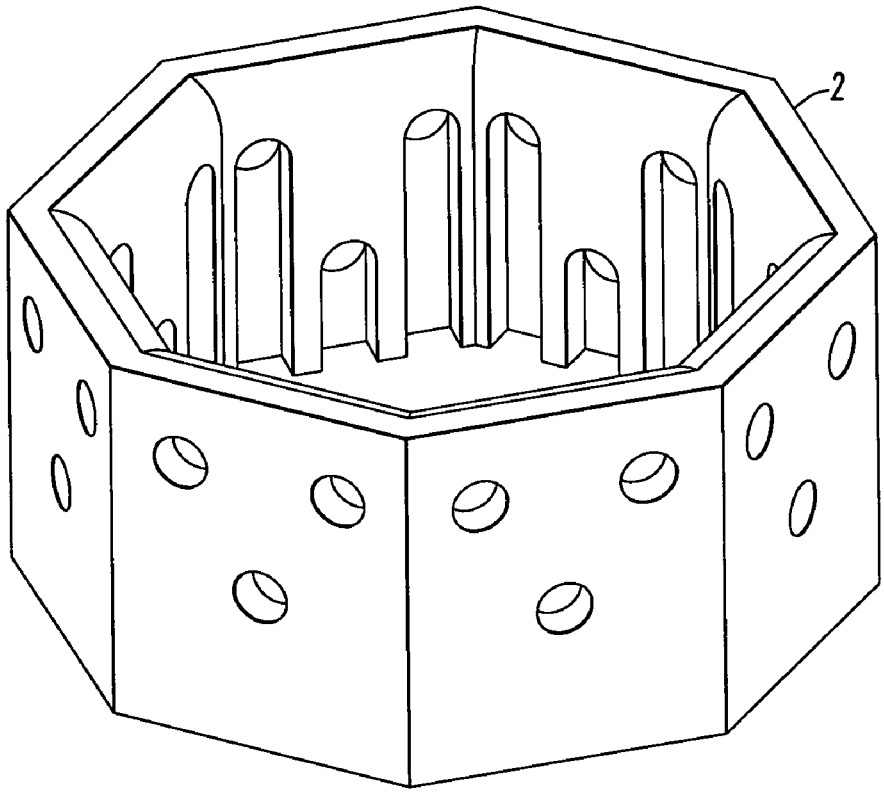
FIG. 9*a* is a perspective view of an alternative embodiment of the present invention.
Figure 9B:
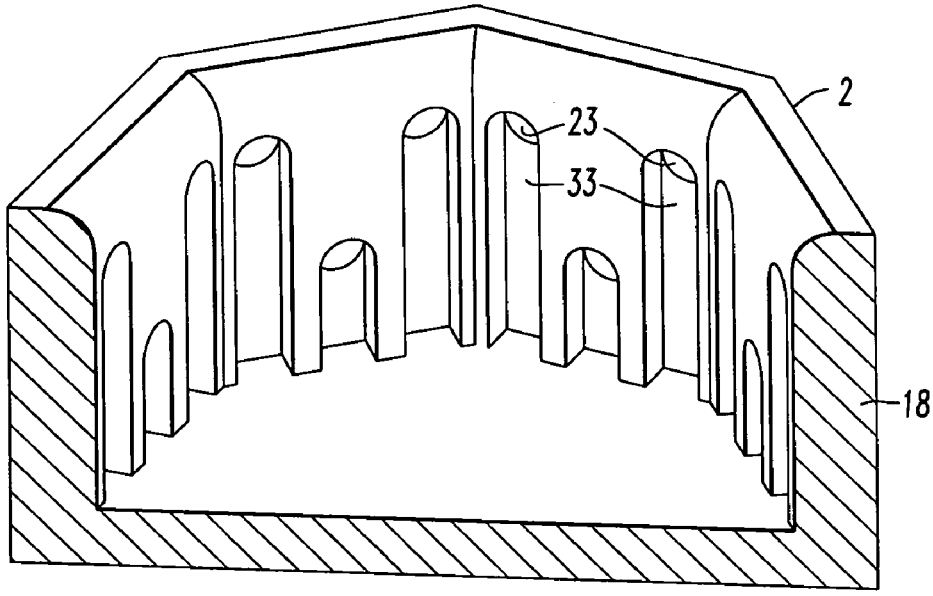
FIG. 9*b* is a cross-sectional, perspective view of FIG. 9*a*.
Figure 10A:
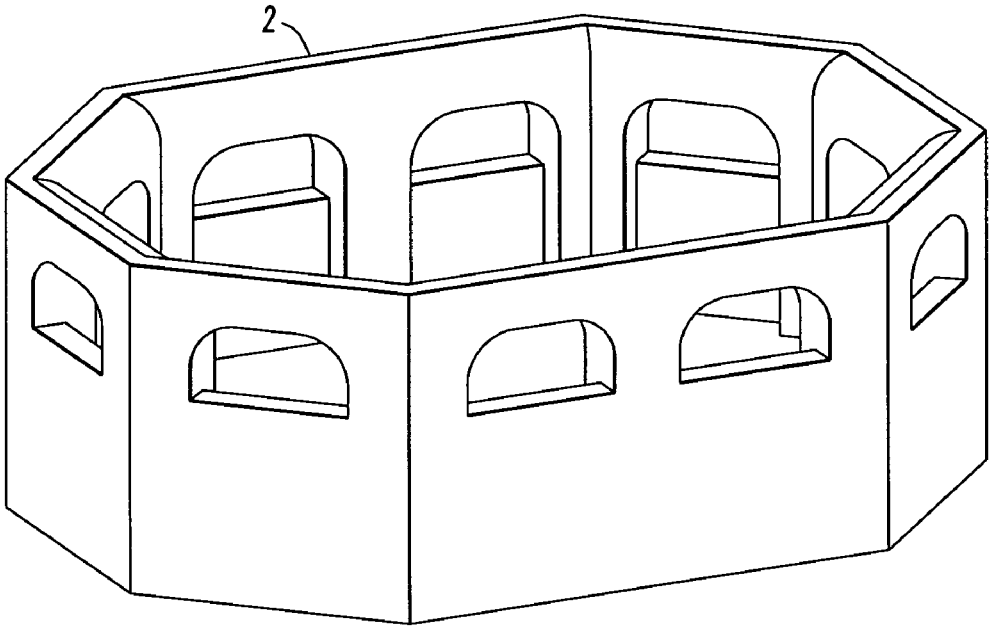
FIG. 10*a* is a perspective view of another alternative embodiment of the present invention.
Figure 10B:
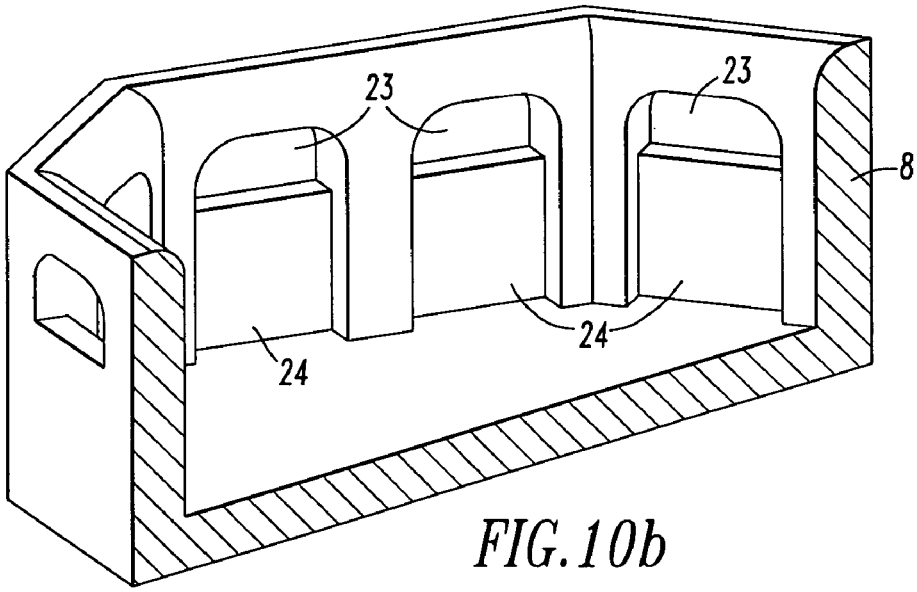
FIG. 10*b* is a cross-sectional, perspective view of FIG. 10*a*.

The sidewall of the invention is not necessarily endless, but the sidewall will always include passageways. The size, number, and location, of the passageways in the sidewall may vary, and the general shape of the pad may also vary. Depending on the internal geometry of the impact pad, the passageways may or may not be vaulted. FIGS. 9 and 10 show perspective views of a second and third embodiment of an impact pad 2 having sidewalls 18 defining passageways 23 of a vaulted architecture 33.

Figure 11:
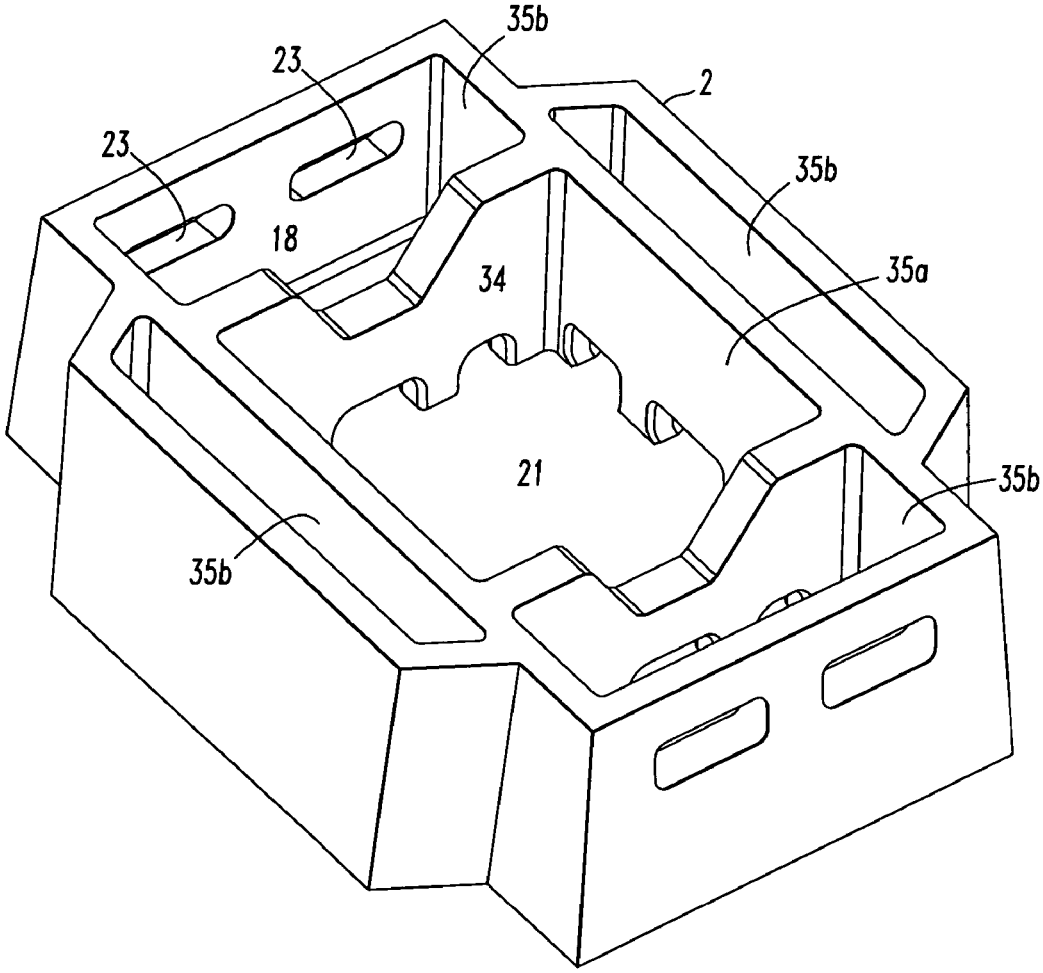
FIG. 11 is perspective view of another alternative embodiment of the present invention that includes weir-like structures.

In another embodiment, as shown in FIGS. 11 and 12, the impact pad 2 includes a base plate 21, at least one sidewall 18 having at least one passageway 23, and at least one weir-type inside wall 34. The sidewalls may be endless or non-endless depending on the particular casting conditions. The passageways 23 may have a vaulted architecture but may also be simple holes through a flat wall. The inside walls 34 define a plurality of chambers 35 within the interior volume of the impact pad 2. Each chamber 35 preferably has a top opening and services as a module for delivering outgoing flow. The central chamber 35*a* with top opening functions mainly as an impacting and receiving chamber so as to arrest the energy associated with a downward stream from the ladle shroud stream. The outflow chambers 35*b* function mainly as delivery modules, which are dedicated to develop steady and evenly distributed plug flow.

The impact pad 2 should separate the incoming stream from the outgoing flow, thereby reducing interaction and mixing between them. Separation of the incoming and outgoing streams permits the central chamber to absorb impacting stream energy and power the flow through the outflow chambers 35*b*. Separation of the streams also permits development of plug flow in the impact pad 2.

Figure 12A:
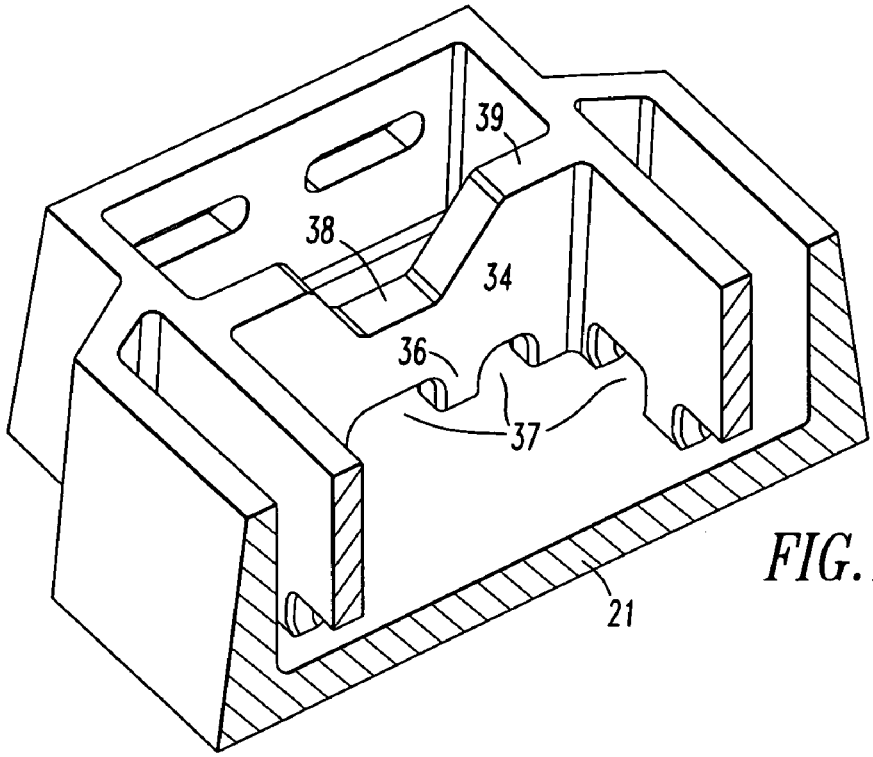
FIG. 12*a* is a transverse cross-sectional view of FIG. 11.
Figure 12B:
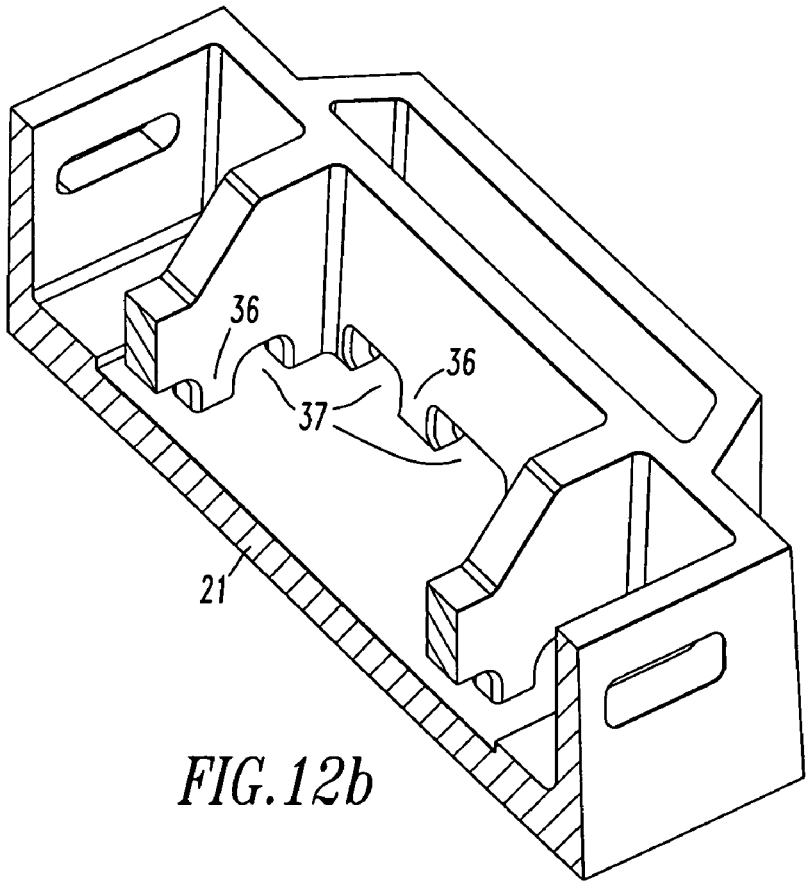
FIG. 12*b* is a longitudinal cross-sectional view of FIG. 12.

The weir-like walls should dissipate kinetic energy of the incoming stream and moderate flow to the outflow chambers. The height, shape and location of the inside weir-type walls may be adjusted for particular casting conditions. In particular, the walls should be adjusted to delivery flow to each chamber so as to obtain plug flow for different tundish configurations. The walls may be of any convenient height, and are often the same height as the sidewalls. Individual walls may even vary in height, and may or may not extend to the base plate. FIGS. 12*a* and 12*b* show weir-like walls 34 having legs 36 extending to the base plate 21. The walls 34, legs 36, and base plate 21 define perforations 37. The perforations permit fluid communication between the chambers 35, in particular fluid communication between the central chamber 35*a* and the outflow chambers 35*b*. With or without perforations, the walls 34 may have depressions 38 in their top surface 39 that permit fluid communication between the chambers 35. Importantly, the walls in any configuration should control flow into the outflow chambers so that the outgoing flow will exit through the passageways 23 and top openings. In this manner, plug flow can occur between the impact pad and the tundish outlet.

The impact pad of the present invention channels an incoming ladle stream through passageways in the sidewall and the open top surface of the pad. The impact pad arrests and uses the high energy associated with the downward stream to feed the passageways. Channeling is facilitated by a vaulted-stepped architecture surrounding the passageways or weir-like walls dividing the impact pad into a plurality of chambers. The outgoing flow leaves the impact pad and proceeds toward the tundish outlet with an evenly distributed speed throughout the height of the tundish. Advantageously, the impact pad separates the incoming stream so as to reduce sensitivity of the flow to disturbance and asymmetries if the impacting flow does not strike the center of the impact pad.

The impact pad of the present invention is capable of addressing particular tundish geometries, including asymmetrical issues, such as single strand, two strands and multiple strands systems. Passageways in the sidewall and outflow chambers can be adapted to specific configurations to meet the fluid flow requirement. For example, the sidewall may be removed to accommodate placement of the impact pad near an end of a tundish.

Although the present invention has been described in relation to particular embodiments thereof, many other variations and modifications and other uses will become apparent to those skilled in the art. The present invention is not to be limited by the specific disclosure herein.

The invention claimed is:

1. A tundish impact pad for use in continuous casting comprising:

a) a base plate having an impact surface adapted to receive and deflect an incoming stream of molten metal, the base plate having a periphery;

b) a sidewall extending upward from the base plate along at least a portion of the periphery and having an interior surface facing the impact surface, the sidewall defining a plurality of passageways surrounded by a vaulted-stepped architecture on the interior surface and adapted to permit at least a portion of the deflected incoming stream to exit through the passageways.

2. The tundish impact pad of claim 1, wherein the sidewall completely encircles the periphery of the base plate, thereby defining an interior volume with an open top surface.

3. The tundish impact pad of claim 2, wherein the sidewall comprises a plurality of facets, and each facet defines at least one passageway.

4. The tundish impact pad of claim 3, wherein the sidewall includes eight facets.

5. The tundish impact pad of claim 1, wherein the vaulted-stepped architecture comprises a first bounding surface arching over the passageway and a second bounding surface forming a step above the passageway.

6. The tundish impact pad of claim 2, characterized by at least one weir-like wall extending up from the base plate, thereby separating the interior volume into a, plurality of chambers.

7. The tundish impact pad of claim 6, wherein a receiving chamber is adapted to receive the incoming stream and is fluidly connected to at least one outflow chamber having an open top portion and a sidewall defining at least one passageway.

8. The tundish impact pad of claim 6, wherein the weir-like wall extends up from the base plate on at least one leg, whereby the leg, wall and base plate define a perforation that permits fluid communication between chambers.

9. The tundish impact pad of claim 6, wherein the weir-like wall includes a top surface and a depression on the top surface that permits fluid communication between chambers.

10. The tundish impact pad of claim 1, wherein at least one weir-like wall extends up from the base plate.

11. A tundish impact pad for use in continuous casting comprising:

a) a base plate having an impact surface adapted to receive and deflect an incoming stream of molten metal, the base plate having a periphery;

b) a sidewall extending upward from the base plate at the periphery of the base plate and completely around the periphery, thereby defining an interior volume, the sidewall comprising a plurality of facets and an interior surface facing the impact surface, each facet defining a at least one passageway surrounded by a vaulted-stepped architecture on the interior surface and adapted to permit at least a portion of the deflected incoming stream to exit through the passageways.

12. The tundish impact pad of claim 11, wherein the vaulted-stepped architecture comprises a first bounding surface arching over the passageway and a second bounding surface forming a step above the passageway.

* * * * *